United States Patent [19]

Hammer et al.

[11] 4,425,530

[45] Jan. 10, 1984

[54] TIME DELAY LAMP BALLAST CIRCUIT

[75] Inventors: Edward E. Hammer, Mayfield Village; Eugene Lemmers, Cleveland Heights, both of Ohio

[73] Assignee: General Electric Company, Schenectady, N.Y.

[21] Appl. No.: 313,878

[22] Filed: Oct. 22, 1981

[51] Int. Cl.[3] ..... H05B 39/04; H05B 41/36

[52] U.S. Cl. ..... 315/104; 315/DIG. 5; 315/97; 315/100; 315/289

[58] Field of Search ..... 315/DIG. 5, DIG. 7, 315/97, 98, 100, 104, 287, 257, 362, 289

[56] References Cited

U.S. PATENT DOCUMENTS

| | | | |
|---|---|---|---|
| 2,497,542 | 2/1950 | Frech | 315/104 X |
| 2,722,628 | 11/1955 | Cates et al. | 315/104 X |
| 2,945,986 | 7/1960 | Brooks et al. | 315/100 |
| 2,965,799 | 12/1960 | Brooks et al. | 315/100 X |
| 3,097,325 | 7/1963 | Cosnuau | 315/100 |
| 3,599,051 | 8/1971 | Lee | 315/100 |
| 3,866,087 | 2/1975 | Powell et al. | 315/104 |
| 3,872,350 | 3/1975 | Powell et al. | 315/104 |

FOREIGN PATENT DOCUMENTS

| | | | |
|---|---|---|---|
| 249468 | 12/1960 | Australia | 315/97 |

*Primary Examiner*—Saxfield Chatmon, Jr.
*Attorney, Agent, or Firm*—Philip L. Schlamp; Fred Jacob

[57] ABSTRACT

A multiple fluorescent lamp ballast circuit of the rapid start type in which heating current is supplied to the lamp cathodes. A time delay switch is connected in series with a starting capacitor across one or more of the lamps, to delay lamp starting until the cathodes are sufficiently heated.

5 Claims, 3 Drawing Figures

TIME DELAY LAMP BALLAST CIRCUIT

The invention is in the field of fluorescent lamp ballast circuits of the rapid start type, for starting and operating a plurality of lamps and providing heating current to the lamp cathodes during starting and operating.

A typical type of rapid start ballast circuit comprises a ballast transformer having a primary winding connected to input terminals for receiving a-c electrical voltage, and a secondary winding connected across two or more series-connected fluorescent lamps. Cathode current supply windings of the transformer are connected to the lamp cathodes to provide heating current in the cathodes during lamp starting and operation. A starting capacitor is connected across one of the lamps to facilitate lamp starting, in well-known manner. The lamp cathodes are heated, by the cathode heating current, to temperatures at which the electron emission material carried thereon can readily emit electrons into the gas discharge of the lamps without adverse effects on the electron emission material. However, during starting of these lamps, the gas discharge begins to occur when the cathodes are heating, but have not heated to the desired operating temperature, and thus electrons are momentarily drawn from, and emitted by, the electron emission material before it has adequately heated, resulting in sputtering of some of the emission material off of the cathodes. Thus, with many startings of the lamps over a period of time, substantial amounts of emission material sputter off and thus deplete the amount of emission material remaining on the cathodes, which results in a shorter useful lamp life.

U.S. Pat. No. 3,866,087 to Powell, incorporated herein by reference thereto, describes the problem and discloses a solution in the form of a time delay relay switch connected in series with the lamps and which, during lamp starting, delays the application of operating voltage across the lamps until the cathodes have had time to heat to suitable electron emissive temperature, which time typically is about one second or a few seconds. This delay relay switch solves the problem of premature and damaging electron emission from the cathodes before they have heated to suitable temperature. However, as is well known in reliability control techniques, every additional component added into an operating circuit represents an additional component that is subject to possible failure so as to disable the system. Thus, a delay relay switch connected in series with the lamps should be capable of staying closed and reliably carrying the lamps' operating current during all operating time periods of the lamps. In achieving this, the switch should be able to withstand the sparking that occurs at its contacts each time the switch closes to start the lamps and pass the full operating current of the lamps, without undue wear or corrosion of the contacts caused by the sparking and which could impair the flow of operating current in the lamps. Also, the delay mechanism of the switch must function to reliably keep the switch contacts closed during lamp operation.

SUMMARY OF THE INVENTION

Objects of the invention are to provide an improved fluorescent lamp circuit of the rapid start type, and to provide such a circuit with a starting time delay switch which is not in the operating current path of the lamps.

The invention comprises, briefly and in a preferred embodiment, a rapid start fluorescent lamp circuit having two or more fluorescent lamps connected in electrical series, means to supply heating current to the lamp cathodes, and a starting capacitor and a time delay switch connected in series across one or more of the lamps, the time delay switch being adapted to close and cause the lamps to start after the lamp cathodes have heated to a desired temperature.

DESCRIPTION OF THE PREFERRED EMBODIMENTS

Figure 1:
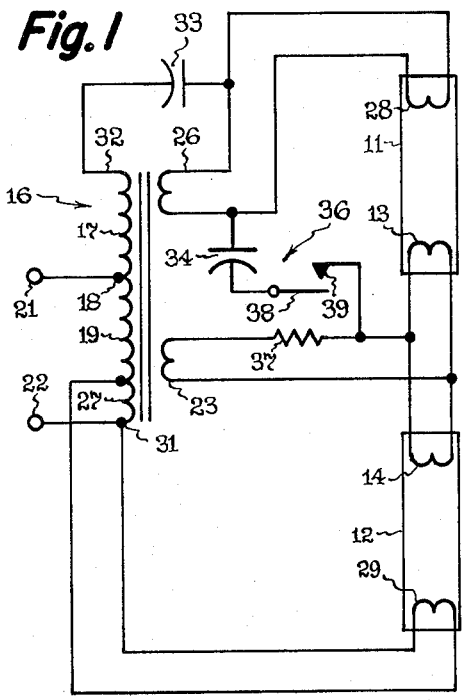
FIGS. 1, 2, and 3 are electrical schematic diagrams of preferred embodiments of the invention.

As shown in FIG. 1, two or more fluorescent lamps 11, 12 are connected in electrical series, by an interconnection of a cathode 13, 14 of each of the lamps by which these cathodes are connected in electrical series, or in electrical parallel as shown. A ballasting autotransformer 16 comprises a secondary winding 17 having a tap 18 thereon to provide a primary winding portion 19 which is connected across a pair of a-c electrical power input terminals 21, 22. A cathode heating winding 23 of the transformer 16 is connected to provide heating current to the interconnected cathodes 13, 14, and additional cathode heating windings 26, 27 of the transformer 16 are respectively connected to provide heating current to the remaining lamp cathodes 28, 29, in well-known manner. The series-connected lamps 11, 12 are connected across the secondary winding 17 by means of a connection of the cathode 29 to an end 31 of the winding 17 and a connection of the cathode 28 to the other end 32 of winding 17 via a customary ballasting capacitor 33, in well-known manner. Conventionally, a starting capacitor 31 would be connected across one of the lamps 11, because the open circuit voltgage (275 RMSvolts, for example, for 40 watt lamps) across the secondary winding 17 is insufficient to start the two series-connected lamps. However, with the starting capacitor 34 across one of the lamps 11, during starting this capacitor applies all of, or a substantial amount of, the secondary winding 17 voltage across the single lamp 12, which is adequate voltage to initiate starting of the lamp 12 by establishing a gas discharge in the lamp between its cathodes 14, 29. When the lamp 12 starts, the voltage drop therein is sufficiently low so that enough voltage appears across the lamp 11 for causing it to start. The two lamps 11, 12 thus start almost simultaneously, as soon as their cathodes heat to a temperature at which they are capable of emitting sufficient electrons for the gas discharge to start. In this type of starting, the cathodes are not sufficiently hot to emit all of the electrons needed for the gas discharge, and some electrons are "pulled out" of the cathode emission material by the electric field potential, causing the above-described sputtering away of emission material each time the lamps are started, resulting in a shortening of lamp life.

In accordance with the invention, a time delay switch 36 is connected in series with the starting capacitor 34; this switch is initially open when power is applied to the input terminals 21, 22, and closes a few seconds later (after the cathodes have heated sufficiently to emit electrons adequately without sputtering of the emission material) thereby connecting the starting capacitor 34 into the circuit and causing the lamps to start in the manner described above. The time delay switch 36 shown in FIG. 1 is generally the same as is disclosed in the above-referenced patent, and comprises a heater resistor 37 connected in series with a cathode current heating circuit, for example in series with the current heating path for cathodes 13 and 14, as shown. A bimetal switch contact strip 38 is positioned adJacent to the resistor 37 so as to be heated thereby, and is spaced from and normally open w1th respect to a fixed contact 39. When the circuit is turned on, the lamp cathodes begin heating and the bimetal switch contact 38 deflects toward the fixed contact 39 and makes contact therewith in about a second or a few seconds, thereby connecting the starting capacitor and causing the lamps to start after their cathodes have heated sufficiently to emit the required quantities of electrons without sputtering.

Figure 2:
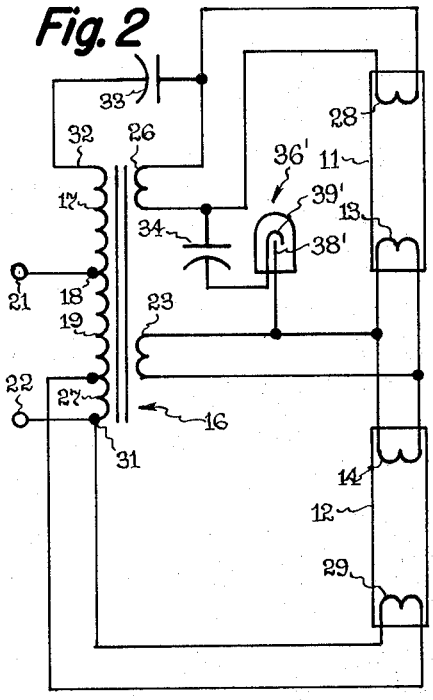

The circuit of FIG. 2 is the same as FIG. 1 except that the time delay switch 36' is a well-known glow starter switch having a fixed contact 39' and a bimetal strip contact 38' contained in an envelope containing a gas such as neon or argon which establishes a glow discharge between the contacts when voltage is applied thereto. This voltage is applied to contact 39' via the ballasting capacitor 33, and to contact 38' via stray capacitance coupling between transformer windings 23 and 19. The glow discharge heats the bimetal contact 38', causing it to deflect against the fixed contact 39' after the desired time delay, thus connecting the starting capacitor 34 for causing the lamps to start.

Figure 3:
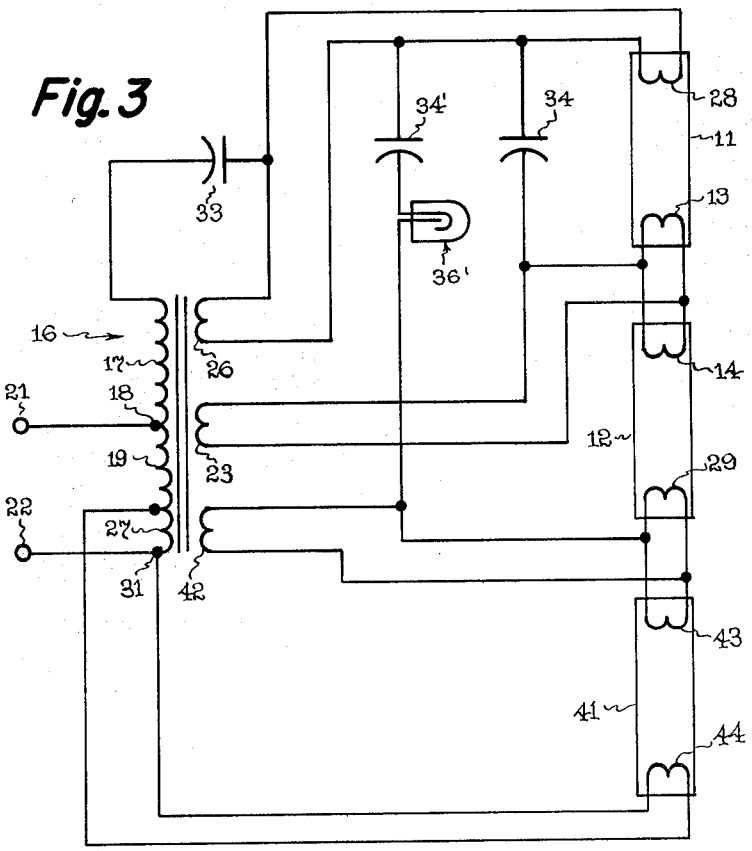

The circuit of FIG. 3 is the same as FIG. 2, except that a third lamp 41 has been added in series with the lamps 11, 12, an additional starting capacitor 31' has been added, and an additional cathode heating winding 42 has been added to the transformer 16 and is connected to supply heating current to the interconnected cathodes 29, 43 of lamps 12 and 41; the remaining cathode 44 of lamp 41 is connected to the cathode current winding 27. The additional starting capacitor 34' is connected across the series-connected lamps 11 and 12, and functions to initially apply voltage of the transformer 16 across the lamp 41, causing it to start, whereupon the starting capacitor 34, applying the transformer voltage across lamp 12 causes it to start, whereupon lamp 11 starts, as described above. The three lamps appear to start simultaneously. The starting time delay switch 36' is connected in series with the additional starting capacitor 34' so that it will delay, for a second or so until the lamp cathodes are heated to a desired temperature for emitting electrons, the starting of the first-to-start lamp 41 whereby it delays starting of all the lamps until their cathodes are sufficiently heated. Alternatively, the time delay switch 34' can be connected in series with the starting capacitor 34 so as to delay starting of lamps 11 and 12; until these lamps start, the discharge current in the first-to-start lamp 41, flowing through starting capacitor 34', is insufficient to cause the undesirable cathode sputtering described above.

The invention achieves a principal advantage not only of protecting the cathodes from sputtering, but also of maintaining system efficiency and reliability. In the prior art, per the above-referenced patent, which places the time delay switch in the lamps' operating current path, the relay contacts must pass the full lamp current continuously while the lamps are lighted, thus subjecting the relay contacts to heating if they should become dusty, dirty, corroded, or oxidized, and this continuous heating can cause further corrosion or oxidation of the contacts, causing a resistive voltage drop which reduces efficiency of the system and potentially causing intermittent or faulty switch contact thus causing flickering or failure of the lamps to produce light. In accordance with the invention, placing the time delay switch in series with the starting capacitor improves system efficiency and reliability in several ways. The current through the switch contacts is very low -- only about 1% to 3% that of the prior art switch contact current, e.g. about 4 to 12 millamperes instead of about 400 milliamperes, and this switch contact current exists for only a fraction of a second during each starting of the lamps, instead of continuously during lamp operation as in the prior art. Thus, the time delay switch contacts in the circuit of the invention are not as subject to adverse effects from dust, dirt, corrosion, and oxidation as in the prior art circuit. Also, in accordance with the invention, if the time delay switch should become erratic or intermittent, it can nevertheless function to delay-start the lamps if its contacts close soon after power is applied to the circuit. While the lamps are operating, erratic or intermittent functioning of the switch has no adverse effect on the light output or efficiency of the system, because the starting capacitors 34, 34' do not function while the lamps are operating.

While preferred embodiments and modifications of the invention have been shown and described, various other embodiments and modifications thereof will become apparent to persons skilled in the art and will fall within the scope of the invention as defined in the following claims.

What we claim as new and desire to secure by U.S. Letters Patent is:

1. A rapid start fluorescent lamp circuit having two or more fluorescent lamps connected in electrical series across a source of operating voltage, means to supply heating current to the lamp cathodes, and a starting capacitor and a time delay switch connected in series across one or more of said lamps, said time delay switch being adapted to close after the cathodes of said lamps have heated to a desired temperature to apply substantially all of the operating voltage across a first one of said lamps to start said first one of said lamps and after starting of said first one of said lamps to allow the application of substantially all of the operating voltage across another of said lamps to start said another of said lamps.

2. A circuit as claimed in claim 1, in which said time delay switch comprises a heater resistor connected in the current path of one or more of said cathodes, and a bimetal switch contact means positioned to be heated by said resistor and connected in series with said starting capacitor.

3. A circuit as claimed in claim 1, in which said time delay switch comprises a glow-starter switch.

4. A circuit as claimed in claim 1, comprising three or more fluorescent lamps connected in electrical series, said starting capacitor being connected across a first one of said lamps, and an additional starting capacitor connected across two of said lamps including said first lamp, said time delay switch being interposed in series with one of said starting capacitors.

5. A circuit as claimed in claim 4, in which said time delay switch is interposed in series with said additional starting capacitor.

* * * * *